US008357057B2

(12) United States Patent
Stites et al.

(10) Patent No.: US 8,357,057 B2
(45) Date of Patent: Jan. 22, 2013

(54) WEIGHT ELEMENT FOR A GOLF CLUB

(75) Inventors: John T. Stites, Weatherford, TX (US); Gary G. Tavares, Azle, TX (US); Robert Boyd, Euless, TX (US); William F. Rauchholz, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/027,643

(22) Filed: Feb. 15, 2011

(65) Prior Publication Data

US 2011/0136586 A1 Jun. 9, 2011

Related U.S. Application Data

(63) Continuation of application No. 12/175,188, filed on Jul. 17, 2008.

(51) Int. Cl.
*A63B 53/04* (2006.01)
*A63B 53/06* (2006.01)

(52) U.S. Cl. ..... 473/339; 473/345

(58) Field of Classification Search ..... 473/324–350
See application file for complete search history.

(56) References Cited

U.S. PATENT DOCUMENTS

| | | | | |
|---|---|---|---|---|
| 1,455,379 | A | | 5/1921 | Allen |
| 1,452,845 | A | | 4/1923 | Pryde |
| 2,517,245 | A | * | 8/1950 | Scott ..... 473/339 |
| 5,447,309 | A | | 9/1995 | Vincent |
| 5,456,464 | A | | 10/1995 | Davenport et al. |
| 5,533,725 | A | | 7/1996 | Reynolds, Jr. |
| 5,720,674 | A | | 2/1998 | Galy |
| 5,755,624 | A | | 5/1998 | Helmstetter |
| 6,001,495 | A | | 12/1999 | Bristow et al. |
| 6,050,904 | A | | 4/2000 | Kuo |
| 6,059,669 | A | | 5/2000 | Pearce |
| 6,273,828 | B1 | | 8/2001 | Wood et al. |
| 6,306,048 | B1 | | 10/2001 | McCabe |

(Continued)

FOREIGN PATENT DOCUMENTS

JP 11244433 9/1999

(Continued)

OTHER PUBLICATIONS

International Search Report corresponding to International Application No. PCT/US2009/049530, mailed Oct. 30, 2009.

(Continued)

*Primary Examiner* — Alvin Hunter
(74) *Attorney, Agent, or Firm* — Banner & Witcoff, Ltd.

(57) ABSTRACT

Wood-type golf club heads (e.g., drivers, fairway woods, wood-type hybrid clubs, or the like) include: (a) a ball striking face; (b) a club head body engaged or integrally formed with the ball striking face, wherein the club head body includes a crown portion, the crown portion including a fixed portion proximal to the ball striking face, and a removable weight portion, which is configured to be coupled with the fixed portion on a side of the crown portion away from the ball striking face. The club head body may further include an interior portion with a frame member defined therein. The crown weight may further include a weight member attached to the frame member, the weight member including at least one receptacle defined therein. The removable weight portion may further include at least one weight insert supported within the weight member in the at least one receptacle.

14 Claims, 12 Drawing Sheets

U.S. PATENT DOCUMENTS

| | | | | |
|---|---|---|---|---|
| 6,331,149 | B1 | 12/2001 | Mikame et al. | |
| 6,334,817 | B1 | 1/2002 | Ezawa et al. | |
| 6,471,604 | B2 | 10/2002 | Hocknell et al. | |
| 6,777,360 | B2 | 8/2004 | Hokkirigawa et al. | |
| 6,955,612 | B2 | 10/2005 | Lu | |
| 7,004,852 | B2 | 2/2006 | Billings | |
| 7,128,660 | B2 | 10/2006 | Gillig | |
| 7,166,040 | B2 | 1/2007 | Hoffman et al. | |
| 7,186,185 | B2 | 3/2007 | Nagy | |
| 7,186,190 | B1 | 3/2007 | Beach et al. | |
| 7,189,169 | B2 | 3/2007 | Billings | |
| 7,771,291 | B1 * | 8/2010 | Willett et al. | 473/337 |
| 8,033,930 | B2 | 10/2011 | Tavares et al. | |
| 2002/0065144 | A1 | 5/2002 | Helmstetter et al. | |
| 2003/0148818 | A1 * | 8/2003 | Myrhum et al. | 473/290 |
| 2004/0138003 | A1 | 7/2004 | Grace | |
| 2004/0176177 | A1 | 9/2004 | Mahaffey et al. | |
| 2006/0100028 | A1 | 5/2006 | Kuo | |
| 2006/0287127 | A1 | 12/2006 | Billings | |
| 2007/0207875 | A1 | 9/2007 | Kuan et al. | |

FOREIGN PATENT DOCUMENTS

| | | |
|---|---|---|
| WO | 03061773 | 7/2003 |
| WO | 2007076304 | 7/2007 |

OTHER PUBLICATIONS

U.S. Office Action related in U.S. Appl. No. 12/175,188, dated Dec. 27, 2010.

U.S. Office Action related in U.S. Appl. No. 12/175,188, dated Apr. 27, 2010.

U.S. Office Action related in U.S. Appl. No. 12/913,391; dated Jul. 29, 2011.

Chinese Office Action in related Chinese Application No. 2009801319539; issued Mar. 12, 2012.

U.S. Final Office Action in related U.S. Appl. No. 12/913,391; mailed Aug. 8, 2012.

* cited by examiner

WEIGHT ELEMENT FOR A GOLF CLUB

This application claims priority to Non-Provisional Application, U.S. Ser. No. 12/175,188, filed Jul. 17, 2008, which is incorporated herein by reference in its entirety.

FIELD OF THE INVENTION

The present invention relates to golf clubs. Particular example aspects of this invention relate to golf clubs having a weight element.

BACKGROUND

In recent years, golf club heads have been designed to improve a golfer's accuracy by assisting the golfer in squaring the club head face at impact with a golf ball. A number of golf club heads have at least some weight positioned so as to alter or control the location of the club head's center of gravity. The location of the center of gravity of the golf club head is one factor that can affect the direction and distance a golf ball will be propelled upon impact with the golf club head. When the center of gravity is positioned directly behind where the golf ball impacts the ball striking face (e.g., impact point), the golf ball follows a generally straight route. When the center of gravity is spaced to a side of the impact point, however, the golf ball may fly in an unintended direction and/or may follow a route that curves left or right resulting in ball flights that often are referred to as "pulls," "pushes," "draws," "fades," "hooks," or "slices". Similarly, when the center of gravity is spaced above or below the impact point, the flight of the golf ball may exhibit more boring or climbing trajectories, respectively.

While the industry has witnessed dramatic changes and improvements to golf equipment in recent years, some golfers continue to experience difficulties in reliably hitting a golf ball in an intended and desired direction and/or with an intended and desired flight path. This is particularly true for clubs used to hit the ball long distances, such as drivers and woods. Accordingly, there is room in the art for further advances in golf club technology.

SUMMARY

Wood-type golf club heads (e.g., drivers, fairway woods, wood-type hybrid clubs, or the like) according to at least some example aspects of this invention include: (a) a ball striking face; and (b) a club head body engaged or integrally formed with the ball striking face, wherein the club head body includes a crown portion. The crown portion may include a fixed portion proximal to the ball striking face, and a removable weight portion, which is configured to be coupled with the fixed portion on a side of the crown portion away from the ball striking face. The club head body may include an interior portion with a frame member defined therein. The removable weight portion may comprise a weight member attached to the frame member, the weight member including at least one receptacle defined therein. The removable weight portion may further comprise at least one weight insert supported within the weight member in the at least one receptacle.

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight inserts; etc.

Still additional aspects of this invention relate to methods for making golf club heads and golf club structures in accordance with examples of this invention. Such methods may include, for example: (a) providing a golf club head of the various types described above, e.g., by manufacturing or otherwise making the golf club head, by obtaining the golf club head from another source, etc.; (b) engaging a shaft member with the golf club head; (c) engaging a grip member with the shaft member; (d) engaging a removable weight portion with the golf club head; and/or (e) engaging a weight member with one or more weight inserts, or other portions of the club head or club structure; etc.

BRIEF DESCRIPTION OF THE DRAWINGS

Aspects of the present invention are illustrated by way of example and not limited in the accompanying figures, in which like reference numerals indicate similar elements throughout, and in which.

Figure 1A:
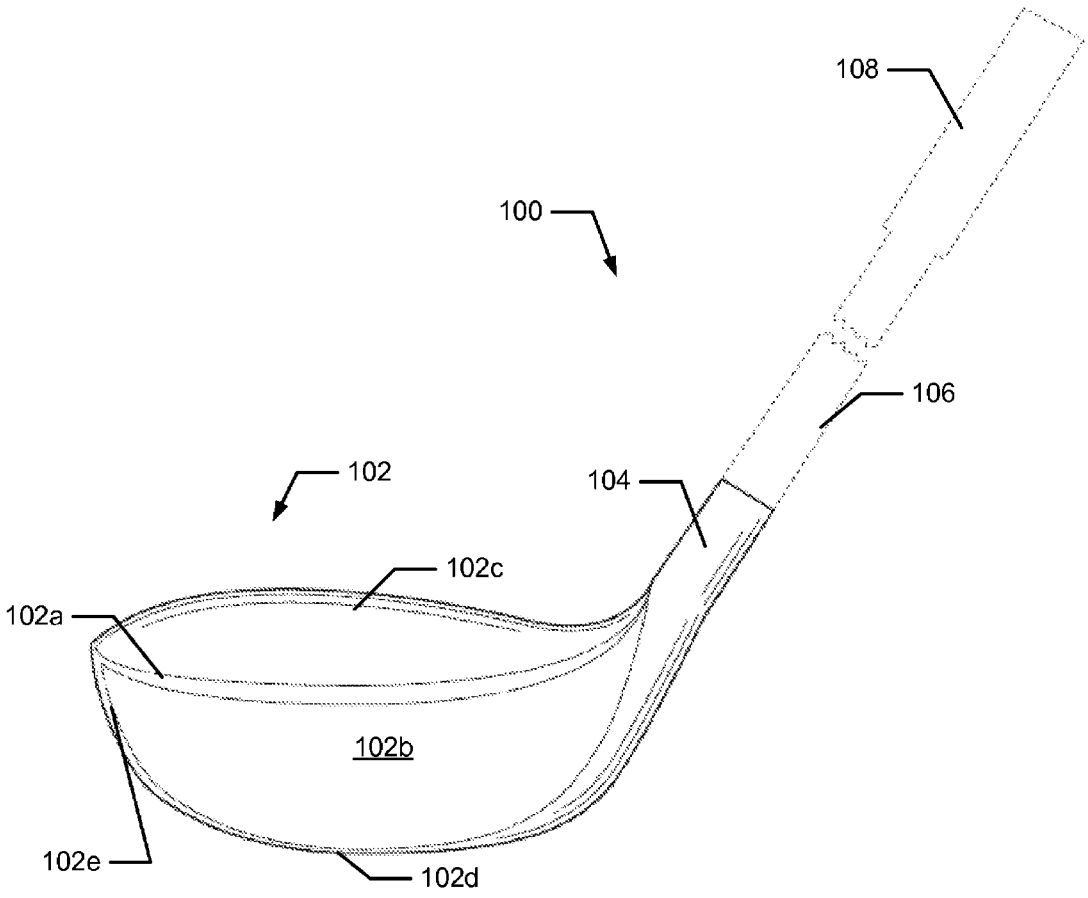
FIGS. 1A and 1B generally illustrate features of a club head structure according to at least some examples of this invention.

The reader is advised that the various parts shown in these drawings are not necessarily drawn to scale.

DETAILED DESCRIPTION

The following description and the accompanying figures disclose features of golf club heads and golf clubs in accordance with examples of the present invention (e.g., wood or wood-type hybrid golf clubs and golf club heads).

I. General Description of Example Golf Club Heads, Golf Clubs, and Methods in Accordance with Aspects of this Invention Aspects of this invention relate to wood-type golf club heads and wood-type golf clubs including such club heads (e.g., drivers, fairway woods, wood-type hybrid clubs, or the like). Wood-type golf club heads according to at least some example aspects of this invention may include: (a) a ball striking face; and (b) a club head body engaged or integrally formed with the ball striking face, wherein the club head body includes a crown portion. The crown portion may include a fixed portion proximal to the ball striking face, and a removable weight portion, which is configured to be coupled with the fixed portion on a side of the crown portion away from the ball striking face. Those skilled in the art will recognize that "coupled with" may also include: mounted in abutting contact with, proximally located with, or located with a flexible gasket-type material. The club head body may include an interior portion with a frame member defined therein.

In other illustrative embodiments of the present invention, the removable weight portion can further include a weight member attached to the frame member, the weight member including at least one receptacle defined therein. The removable weight portion may further comprise at least one weight insert supported in the receptacle of the weight member.

In another example, at least one weight insert is at least partially located within at least one receptacle. The at least one weight insert may be configured to be mounted within the receptacle on a side of the crown portion away from the ball striking face.

The wood-type golf club head body may take on a variety of forms without departing from this invention. For example, the golf club head body may be made from any desired number of different parts, of any desired construction, from any desired materials, etc., without departing from this invention, including from conventional parts, of conventional constructions, and/or from conventional materials as are known and used in the art. In some example structures, the club head body will include one or more of the following parts: a crown portion, a sole portion, a face member (optionally including a ball striking face integrally formed therein or attached thereto), one or more body ribbons (e.g., forming or defining the periphery of the club head between the crown and sole portions), a sole plate, a frame member (optionally of metal, such as titanium alloys or the like, e.g., forming or defining the periphery of the club head between the crown and sole portions and/or to which one or more of the crown portion and/or the sole portion (if present) are engaged, etc.), an aft body, etc. The club head body may include: one or more metal alloy parts (e.g., a frame, optionally including or engaged with the ball striking face, a face member, etc.), such as stainless steel, titanium alloys, aluminum alloys, magnesium alloys, etc.; polymeric materials (e.g., for the crown or sole portions, for the club head body portions between the crown and sole portions, for the face member, etc.); composite materials, including fiber or particle reinforced composite materials, such as carbon fiber composite materials, basalt fiber composite materials, fiberglass materials, etc. (e.g., for the crown or sole portions, for the club head body portions between the crown and sole portions, for the face member, etc.). As yet another example, if desired, the club head body may have a unitary one piece construction, optionally with the frame member integrally formed therein, and further with a separate removable weight portion (and optionally a separate weight insert, if desired) engaged therewith. Any desired structure and/or arrangement of the club head body structure and/or its various parts may be used without departing from this invention.

Also, any desired construction for the removable weight portion, weight member, or weight insert may be used without departing from the invention. If desired, the weight insert may be movably and/or releasably engaged with the weight member or crown portion in any desired manner without departing from this invention, including through the use of mechanical connectors, retaining member structures, spring-loaded connectors and/or retaining structures, and the like. More specific examples of weight inserts and their engagement with the remainder of a club head body are described below.

Additional aspects of this invention relate to wood-type golf club structures that include golf club heads, e.g., of the types described above. Such wood-type golf club structures further may include one or more of: a shaft member attached to the club head (optionally via a separate hosel member or a hosel member provided as a part of one or more of the club head and/or shaft); a grip or handle member attached to the shaft member; an additional weight member attached to one or more of the club head body, shaft, or grip; etc.

Still additional aspects of this invention relate to methods for making wood-type golf club heads and wood-type golf club structures in accordance with examples of this invention. Such methods may include, for example: (a) providing a golf club head of the various types described above (including any or all of the various structures, features, and/or arrangements described above), e.g., by manufacturing or otherwise making the golf club head, by obtaining it from a third party source, etc.; (b) engaging a shaft member with the golf club head; (c) engaging a grip member with the shaft member; (d) engaging a removable weight portion with the club head body; and/or (e) engaging one or more weight inserts with the club head, e.g., with the weight member, and/or removable weight portion, etc.

Additional aspects of this invention relate to methods of using wood-type golf club heads, e.g., of the various types described above. Such methods may include, for example, moving the removable weight portion to various positions along the crown portion or even the sole portion. In this manner, golf clubs and golf club heads in accordance with examples of this invention may be customized, e.g., to better fit or conform to a specific golfer's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like. Golf club heads and/or golf clubs according to the invention also may be used by club fitters to find desired or optimal weighting characteristics for specific golfers, and if desired, such characteristics may be used in selecting parts, arranging weights, and/or weighting for a final, permanently weighted club structure.

Given the general description of various example aspects of the invention provided above, more detailed descriptions of various specific examples of golf clubs and golf club head structures according to the invention are provided below.

II. Detailed Description of Example Golf Club Heads, Golf Club Structures, and Methods According to Aspects of the Invention The following discussion and accompanying figures describe various example golf clubs and golf club head structures in accordance with aspects of the present invention. When the same reference number appears in more than one drawing, that reference number is used consistently in this specification and the drawings to refer to the same or similar parts throughout.

Example golf club and golf club head structures in accordance with this invention may constitute "wood-type" golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The club heads may include a multiple piece construction and structure, e.g., including one or more of a sole member, a face member (optionally including a ball striking face integrally formed therein or attached thereto), one or more body members (e.g., ribbons of material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of wood-type golf club heads and golf club structures according to this invention will be described in detail below in conjunction with the example golf club structures illustrated in FIGS. 1A through 6.

Figure 1B:
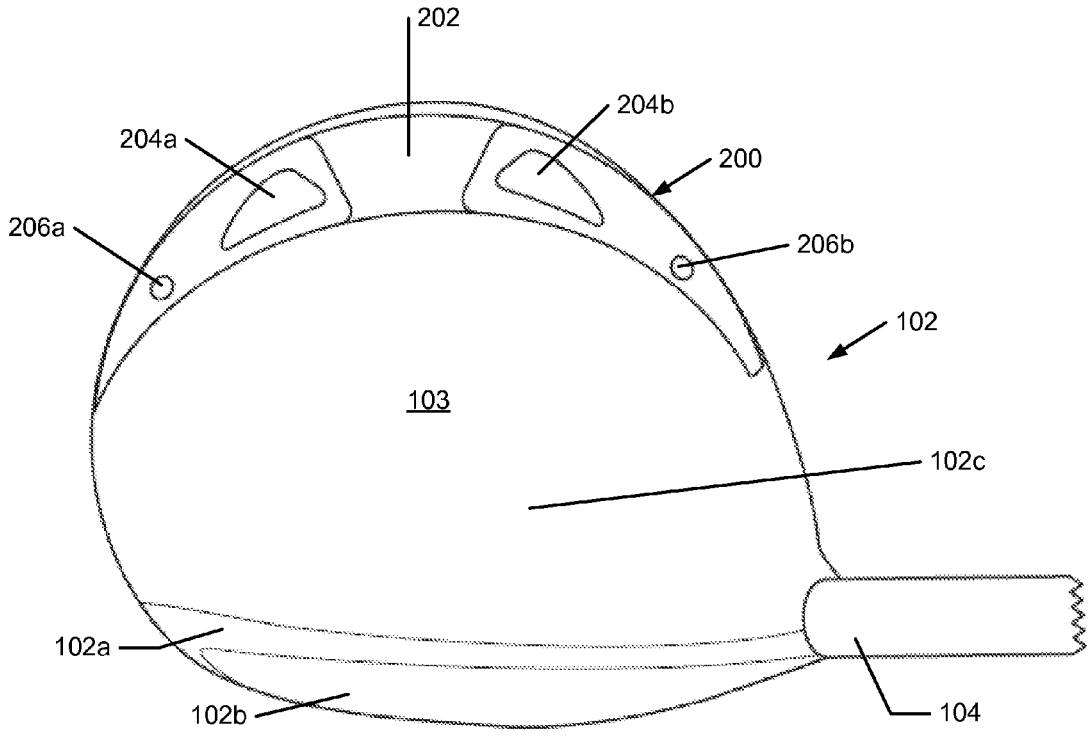

FIGS. 1A and 1B generally illustrate an example wood-type golf club 100 and/or golf club head 102 in accordance with this invention. In addition to the golf club head 102, the overall golf club structure 100 of this example includes a hosel region 104, a shaft member 106 received in and/or inserted into and/or through the hosel region 104, and a grip or handle member 108 attached to the shaft member 106. Optionally, if desired, the external hosel region 104 may be eliminated and the shaft member 106 may be directly inserted into and/or otherwise attached to the head member 102 (e.g., through an opening provided in the top of the club head 102, through an internal hosel member (e.g., provided within an interior chamber defined by the club head 102), etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member 108 materials may be used without departing from this invention, including, for example: rubber materials, leather materials, rubber or other materials including cord or other fabric material embedded therein, polymeric materials, and the like.

The club head 102 also may be constructed in any suitable or desired manner and/or from any suitable or desired materials without departing from this invention, including from conventional materials and/or in conventional manners known and used in the art. In the example structure 102 shown in FIGS. 1A and 1B, the club head 102 includes a ball striking face member 102*a* (including a ball striking face plate 102*b* integrally formed with the face member 102*a* or attached to a frame member such that the face plate 102*b* and frame member together constitute the overall face member 102*a*). The club head 102 of this illustrated example further includes a crown portion 102*c*, a sole portion 102*d*, and at least one body portion 102*e* located between the crown portion 102*c* and the sole portion 102*d* (e.g., a "ribbon" of material extending from the face member 102*a* toe to heel and around the club head periphery).

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown portion 102*c*, sole portion 102*d*, and/or body portion(s) 102*e*) may be made from any desired materials and combinations of different materials, including materials that are conventionally known and used in the art, such as metal materials, including lightweight metal materials. More specific examples of suitable lightweight metal materials include steel, titanium alloys, aluminum alloys, magnesium alloys, etc.

As additional examples or alternatives, in order to reduce weight of the club head 102, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. As some more specific examples, if desired, at least some portion(s) of the crown member 102*c* may be made from composite or other non-metal materials. Additionally or alternatively, if desired, at least some portion(s) of the sole member 102*d* may be made from composite or other non-metal materials. As still additional examples or alternatives, if desired, one or more portions of the club head's body member 102*e* (the regions or "ribbons" of material (e.g., one or more substantially "U-shaped" ribbons) extending between the crown portion 102*c* and the sole portion 102*d*) may be made from composite or other non-metal materials. As yet further examples, if desired, the entire body portion of the club head aft of a club head face member 102*a* (also called an "aft body"), or optionally the entire club head, may be made from composite or other non-metal materials without departing from this invention. The composite or other non-metal material(s) may be incorporated as part of the club head structure 102 in any desired manner, including in conventional manners that are known and used in the art. Reducing the club head's weight (e.g., through the use of composite or other non-metal materials, lightweight metals, metallic foam or other cellular structured materials, etc.) allows club designers and/or club fitters to selectively position additional weight in the overall club head structure 102, e.g., to desirable locations to increase the moment of inertia (MOI) and/or affect other playability characteristics of the club head structure 102 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.; etc.).

The various individual parts that make up a club head structure 102, if made from multiple pieces, may be engaged with one another and/or held together in any suitable or desired manner, including in conventional manners known and used in the art. For example, the various parts of the club head structure 102, such as the face member 102*a*, the ball striking plate 102*b*, the crown portion 102*c*, the sole portion, 102*d*, and/or the body portion(s) 102*e* may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, and/or 102*e* contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure 102 according to examples of this invention may vary significantly without departing from the invention. As some more specific examples, club heads in accordance with at least some examples of this invention may have dimensions and/or other characteristics that fall within the various example ranges of dimensions and/or characteristics of the club heads described in U.S. patent application Ser. No. 11/125,327 filed May 10, 2005 (and corresponding to U.S. Published Patent Appln. No. 2005-0239576 A1 published Oct. 27, 2005). Note, for example, the Tables in these documents. This U.S. patent publication is entirely incorporated herein by reference. In accordance with at least some example club head structures according to this invention, the ratio of the breadth dimension (i.e., overall dimension "B" in the front to back direction) to length dimension (i.e., overall dimension "L" from in the heel to toe direction) (i.e., ratio "B/L") will be at least 0.9, and in some examples, this ratio may be at least 0.92, at least 0.93, at least 0.94, at least 0.95, at least 0.96, at least 0.97, or even at least 0.98. The club head may have any desired volume, including, for example, a volume of at least 200 cc, and in some examples at least 350 cc, at least 400 cc, at least 420 cc, or even at least 450 cc. It will be appreciated that the breadth dimension to length dimension and volume could be outside these listed ranges.

FIG. 1B specifically illustrates the feature of the removable weight portion 200. The crown portion 102*c* generally includes a fixed portion 103 and the removable weight portion 200. The fixed portion 103 is located proximal to the ball striking face 102*b*. The removable weight portion 200 is configured to be coupled with the fixed portion 103 on a side of the crown portion 102*c* away from the ball striking face 102*b*. A gasket may be used between the removable weight portion 200 and the fixed portion 103. The removable weight portion 200 is generally located at the rear area of the crown portion 102*c*. The removable weight portion 200 may include a weight member 202 and weight inserts 204*a*, 204*b*. The weight member 202 may include one or more receiving holes (not shown) for receiving mechanical connectors 206*a*, 206*b*. The mechanical connectors 206*a*, 206*b* may be used to attach the removable weight portion 200 to the club head 102 as will be described in more detail below. It will be appreciated that in the embodiment depicted in FIG. 1B, the general profile of the club head 102 is maintained when the removable weight portion 200 is attached to the club head 102. In other implementations of the invention, the profile of the club head 102 may change.

Figure 2A:
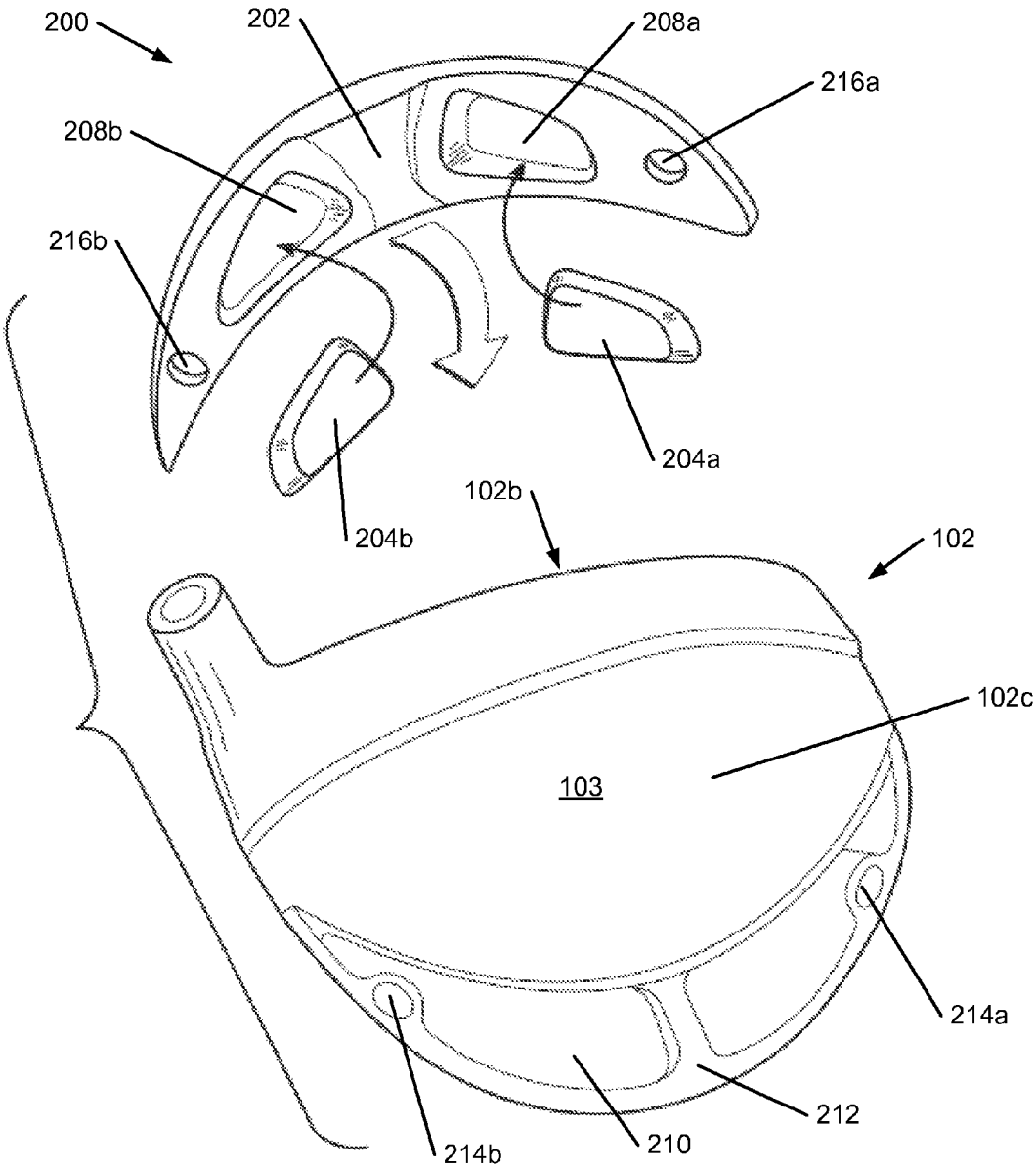
FIGS. 2A through 2C illustrate a golf club head structure including a removable weight portion with weight inserts in accordance with at least some examples of this invention.
Figure 2B:
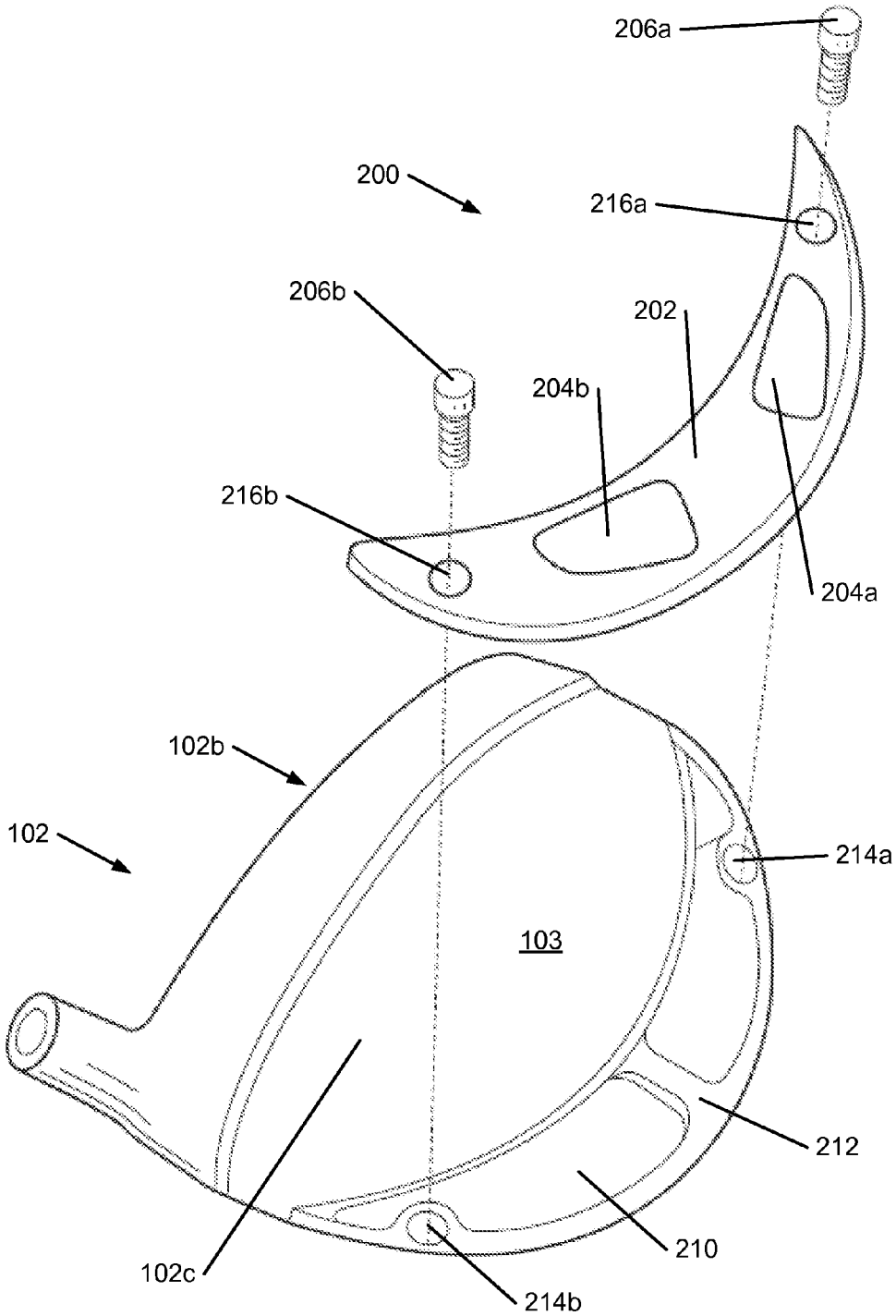
Figure 2C:
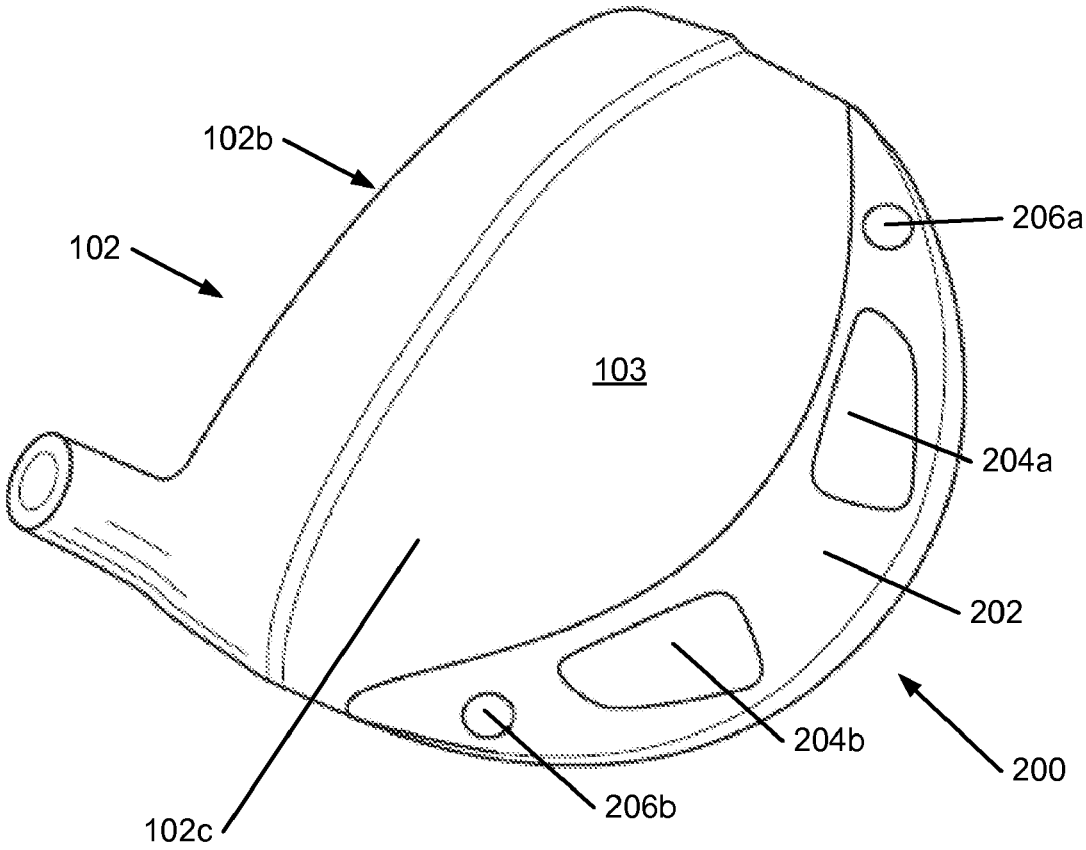

FIGS. 2A-2C—Removable Weight Portion with Weight Inserts

FIGS. 2A through 2C illustrate an additional example feature and structure that may be included in golf club 100 and golf club head 102 structures in accordance with this invention. As shown in these figures, the top or crown portion 102*c* of this club head structure 102 includes a fixed portion 103 and a removable weight portion 200. The fixed portion 103 is located proximal to the ball striking face 102*b*. The removable weight portion 200 may be configured to be coupled with the fixed portion 103 on a side of the crown portion 102*c* away from the ball striking face 102*b*. A gasket may be used between the removable weight portion 200 and the fixed portion 103. Additionally, the interior of the golf club head 102 may include a frame member 212 that is located adjacent to the fixed portion 103 on a side of the crown portion 102*c* away from the ball striking face 102*b* and within a cavity 210. The cavity 210 is formed by the frame member 212, crown portion 102*c*, and fixed portion 103. The cavity 210 may be located to the rear or away from the side of the crown portion 102*c* proximal to the ball striking face 102*b*. The cavity 210 may also be a slot or a groove. In this illustrative embodiment, the cavity 210 may extend along the rear area of the crown portion 102*c* and further, wrap around the rear area of the crown portion 102*c*. The cavity 210 may be open or "bottomless" (e.g., so that it opens into an open or hollow space defined by the crown portion 102*c* and the frame member 212) or closed (e.g., extending only partially through the crown portion 102*c*, abutting up against the frame member, etc.) without departing from this invention.

As shown, the frame member 212 may be formed to include appropriate structures (such as threaded holes at the locations of mounting members 214*a*, 214*b*, etc.) that engage mechanical connectors 206*a*, 206*b* (such as screws) to hold the removable weight portion 200 and the frame member 212 or golf club head 102 together.

The removable weight portion 200 in FIG. 2A includes a weight member 202 and at least one weight insert 204*a* and/or 204*b*, two in this example. If desired, additional weight inserts 204*a*, 204*b* may be used with the removable weight portion 200. The weight member 202 further includes at least one receptacle 208*a* and/or 208*b*, two in this example. The number of receptacles 208*a*, 208*b* may equal the number of weight inserts 204*a*, 204*b*. As shown, the weight member 202 may include at least one receiving hole (e.g., screw hole) 216*a*, 216*b*, two in this example, for receiving a mechanical connector 206*a*, 206*b* (two in this example) and for attaching the removable weight portion 200 to the golf club head 102. The mechanical connectors 206*a*, 206*b* (e.g., screws, rivets, turnbuckles, etc.) may extend through the receiving holes 216*a*, 216*b*, and through the openings in the mounting members 214*a*, 214*b*, respectively, in the frame member 212 (e.g., threaded holes, nuts, etc.). There may be one or more receiving holes 216*a*, 216*b*. The number of receiving holes 216*a*, 216*b* may be equal to the number of mounting members 214*a*, 214*b* and the number of mechanical connectors 206*a*, 206*b*, which can be accommodated.

As illustrated in FIG. 2B, the weight inserts 204*a*, 204*b* can be inserted into the receptacles 208*a*, 208*b* of the weight member 202. Notably, the weight inserts 204*a*, 204*b* may have reverse angle edges (i.e. the edges are angled in from the bottom to top of the weight insert) such that the weight inserts 204*a*, 204*b* can only be inserted into the receptacle 208*a*, 208*b* and weight member 202 from the bottom side of the weight member 202. As the weight inserts 204*a*, 204*b* are attached to the frame member 212 and the golf club head 102, the weight inserts 204*a*, 204*b* are thus maintained in the golf club head 102. The reverse angle edges help to maintain the weight inserts 204*a*, 204*b* within the receptacles 208*a*, 208*b* of the weight member 202 without the use of any additional connectors (such as screws, rivets or the like) specifically for the weight inserts 204*a*, 204*b*.

As also illustrated in FIG. 2B, the mechanical connectors 206*a*, 206*b* are inserted through the receiving holes 216*a*, 216*b* through the mounting members 214*a*, 214*b* to attach the weight member 202 of the removable weight portion 200 to the frame member 212 and golf club head 102. A wide variety of other ways of securing the weight member 202 of the removable weight portion 200 to the frame member 212 and golf club head 102 are possible without departing from this invention, including, for example, friction fits, mechanical connectors, retaining member/groove or opening structures, spring loaded mechanisms, hook and loop fasteners, etc. If desired, the exposed head of the mechanical connectors 206*a*, 206*b* may fit into a countersink opening provided in the top surface of the weight member 202 so that the mechanical connectors heads are flush to the weight member 202 and the rest of the crown portion 102*c* of the golf club head 102. If desired, cover members may be provided (not shown) to cover any exposed or open holes to prevent dirt or debris from entering the cavity 210 and/or the club head body interior during use.

As illustrated in FIG. 2C, the removable weight portion 200 is attached to the rear area of the crown portion 102*c* and coupled with the fixed portion 103 on the side of the crown portion 102*c* away from the ball striking face 102*b*. A gasket may be used between the removable weight portion 200 and the fixed portion 103. The weight inserts 204*a*, 204*b* may be held within the weight member 202 by the reverse-angled edges so that the weight inserts 204*a*, 204*b* do not fall out upon swinging the golf club 100 or golf club head 102. A wide variety of sizes, shapes, positioning, orientations, relative orientations, mass, and/or materials may be used for the removable weight portion 200, the weight member 202, and the weight inserts 204*a*, 204*b* without departing from this invention. Such constructions enable users (or club fitters) to provide additional weight in the toe and/or rear portion(s) of an overall club head structure 102, which can be useful to provide a fade biased club and/or a club that helps compensate for swing flaws that typically produce a drawing or hooking ball flight.

Also, changing the removable weight portion 200, weight member 202 or weight inserts 204*a*, 204*b* may allow users or club fitters to affect the flight of balls propelled using club heads 102 and golf clubs 100 in accordance with these examples of the invention. For example, it is typically easier for at least some golfers to get a golf ball airborne using a club head 102 having significant weight located lower and toward the rear of the club head 102. Such weight positioning also may be used to provide a higher, more lofted golf ball flight path, at least for some golfers. Under some play conditions and/or for some swing types, however, this higher flight bias and/or ball flight path may not be desirable. For example, to produce lower, more boring ball flights, e.g., for play in windy conditions, or for swing flaws that typically produce an excessively high, ballooning ball flight, the weight may be positioned more forward toward the ball striking face 102*b*.

Figure 3A:
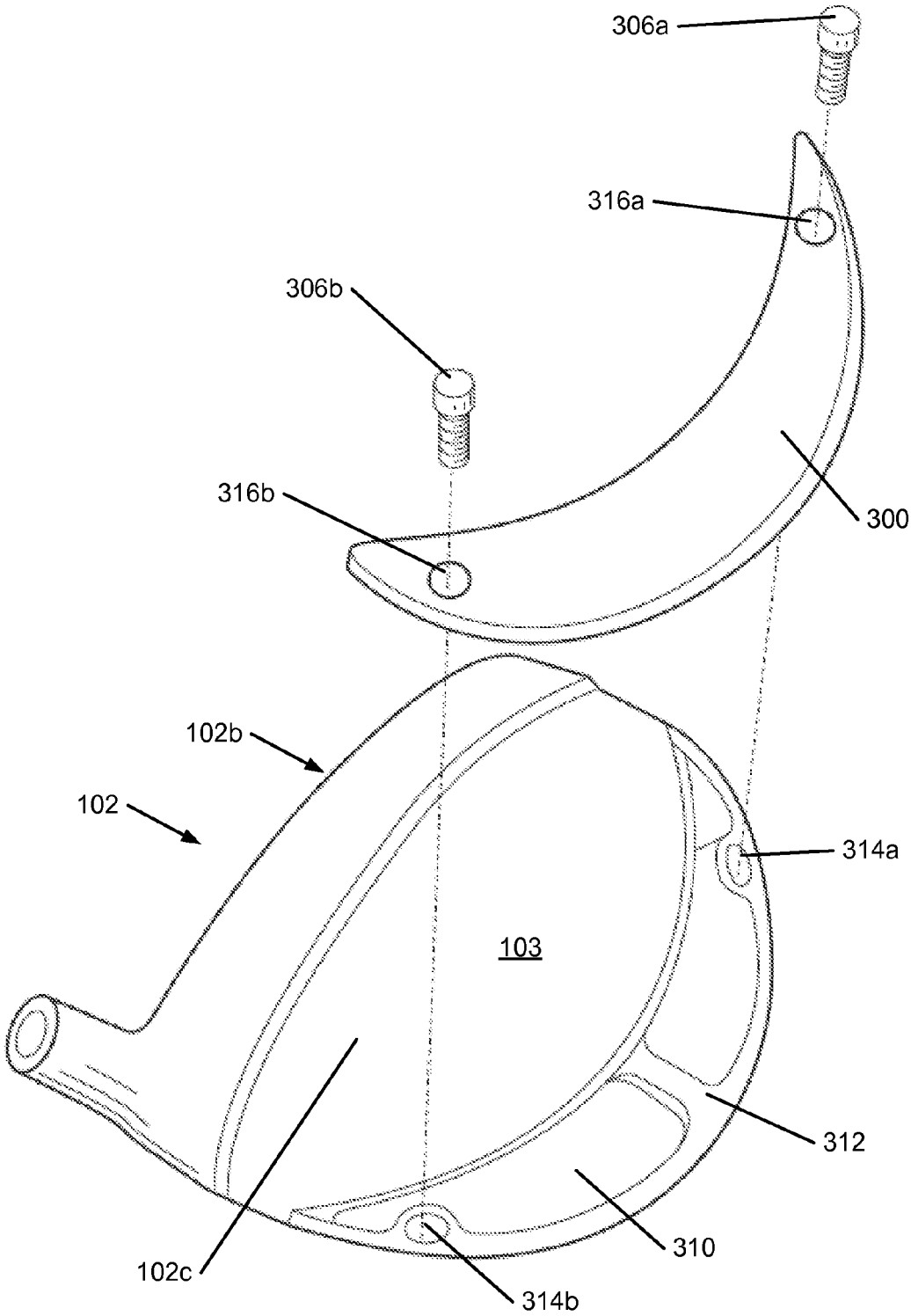
FIGS. 3A and 3B illustrate a golf club head structure including a removable weight portion that may be used in accordance with at least some examples of this invention.
Figure 3B:
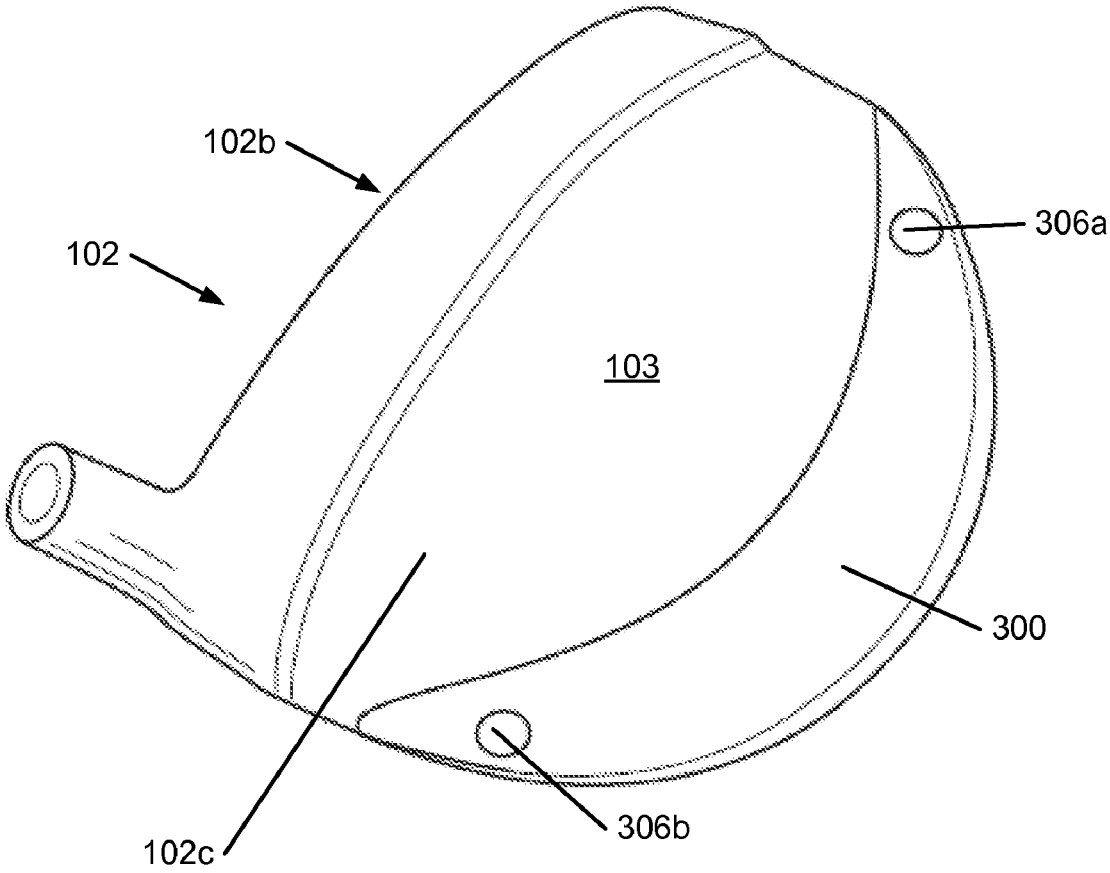

FIGS. 3A & 3B—Removable Weight Portion Only

FIGS. 3A and 3B illustrate an additional example feature and structure that may be included in golf club 100 and golf club head 102 structures in accordance with this invention. As shown in these figures, the top or crown portion 102*c* of this club head structure 102 includes a fixed portion 103 and a removable weight portion 300. The fixed portion 103 is located proximal to the ball striking face 102*b*. The removable weight portion 300 may be configured to be coupled with the fixed portion 103 on a side of the crown portion 102*c* away from the ball striking face 102*b*. A gasket may be used between the removable weight portion 300 and the fixed portion 103. Additionally, the interior portion of the golf club head 102 includes a frame member 312 that is located adjacent to the fixed portion 103 on a side of the crown portion 102*c* away from the ball striking face 102*b* and within a cavity 210. The cavity 310 is formed by the frame member 312, crown portion 102*c*, and fixed portion 103. The cavity 310 may be located to the rear or away from the side of the crown portion 102*c* proximal to the ball striking face 102*b*. The cavity 310 may also be a slot or a groove. In this illustrative embodiment, the cavity 310 may extend along the rear area of the crown portion 102*c*, and further wrap around the rear area of the crown portion 102*c*. The cavity 310 may be open or "bottomless" (e.g., so that it opens into an open or hollow space defined by the crown portion 102*c* and the frame member 312) or closed (e.g., extending only partially through the crown portion 102*c*, abutting up against the frame member 312, etc.) without departing from this invention.

As shown, the frame member 312 may be formed to include appropriate structures (such as threaded holes at the locations of mounting members 314*a*, 314*b*, etc.) that engage mechanical connectors 306*a*, 306*b* (such as screws) to hold the removable weight portion 300 and the frame member 312 or golf club head 102 together.

The removable weight portion 300 in FIG. 3A may include at least one receiving hole 316*a*, 316*b* (e.g., screw hole), two in this example, for receiving a mechanical connector 306*a*, 306*b* (two in this example) for holding the removable weight portion 300 to the golf club head 102. The mechanical connectors 306*a*, 306*b* (e.g., screws, rivets, turnbuckles, etc.) may extend through the receiving holes 316*a*, 316*b*, and through the openings in the mounting members 314*a*, 314*b*, respectively, in the frame member 312 (e.g., threaded holes, nuts, etc.). There may be one or more receiving holes 316*a*, 316*b*. The number of receiving holes 316*a*, 316*b* may be equal to the number of mounting members 314*a*, 314*b* and the number of mechanical connectors 306*a*, 306*b*, which can be accommodated.

As illustrated in FIG. 3B, the mechanical connectors (e.g., screws) 306*a*, 306*b* are inserted through the receiving holes 316*a*, 316*b* through the mounting members 314*a*, 314*b* to attach the removable weight portion 300 to the frame member 312 and golf club head 102. A wide variety of other ways of securing the removable weight portion 300 to the frame member 312 and golf club head 102 are possible without departing from this invention, including, for example, friction fits, mechanical connectors, retaining member/groove or opening structures, spring loaded mechanisms, hook and loop fasteners, etc. If desired, the exposed head of the mechanical connector 306*a*, 306*b* may fit into a countersink opening provided in the top surface of the removable weight portion 300 so that the mechanical connector head is flush to the removable weight portion 300 and the rest of the crown portion 102*c* of the golf club head 102. If desired, cover members may be provided (not shown) to cover any exposed or open holes to prevent dirt or debris from entering the cavity 310 and/or the club head body interior during use.

Furthermore, as illustrated in FIG. 3B, the removable weight portion 300 is attached to the rear area of the crown portion 102*c* and coupled with the fixed portion 103 on the side of the crown portion 102*c* away from the ball striking face 102*b*. A wide variety of sizes, shapes, positioning, orientations, relative orientations, mass, and/or materials may be used for the removable weight portion 300 without departing from this invention. Such constructions enable users (or club fitters) to provide additional weight in the toe and/or rear portion(s) of an overall club head structure 102, which can be useful to provide a fade biased club and/or a club that helps compensate for swing flaws that typically produce a drawing or hooking ball flight.

Also, changing the removable weight portion 300 may allow users or club fitters to affect the flight of balls propelled using club heads 102 and golf clubs 100 in accordance with these examples of the invention. For example, it is typically easier for at least some golfers to get a golf ball airborne using a club head 102 having significant weight located lower and toward the rear of the club head 102. Such weight positioning also may be used to provide a higher, more lofted golf ball flight path, at least for some golfers. Under some play conditions and/or for some swing types, however, this higher flight bias and/or ball flight path may not be desirable. For example, to produce lower, more boring ball flights, e.g., for play in windy conditions, or for swing flaws that typically produce an excessively high, ballooning ball flight, the weight may be positioned more forward toward the ball striking face.

Figure 4A:
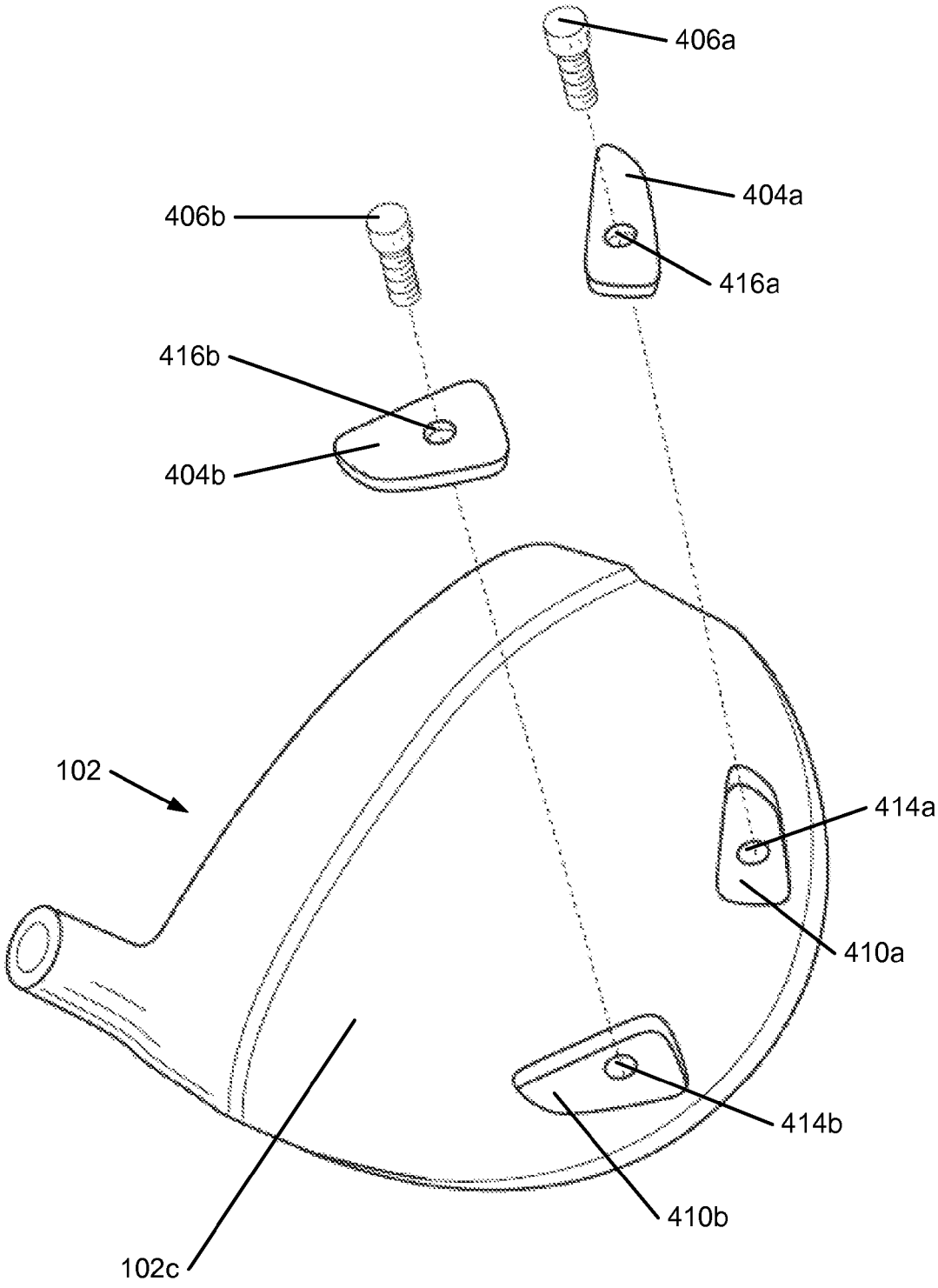
FIGS. 4A and 4B illustrate a golf club head structure including weight inserts that may be used in accordance with at least some examples of this invention.
Figure 4B:
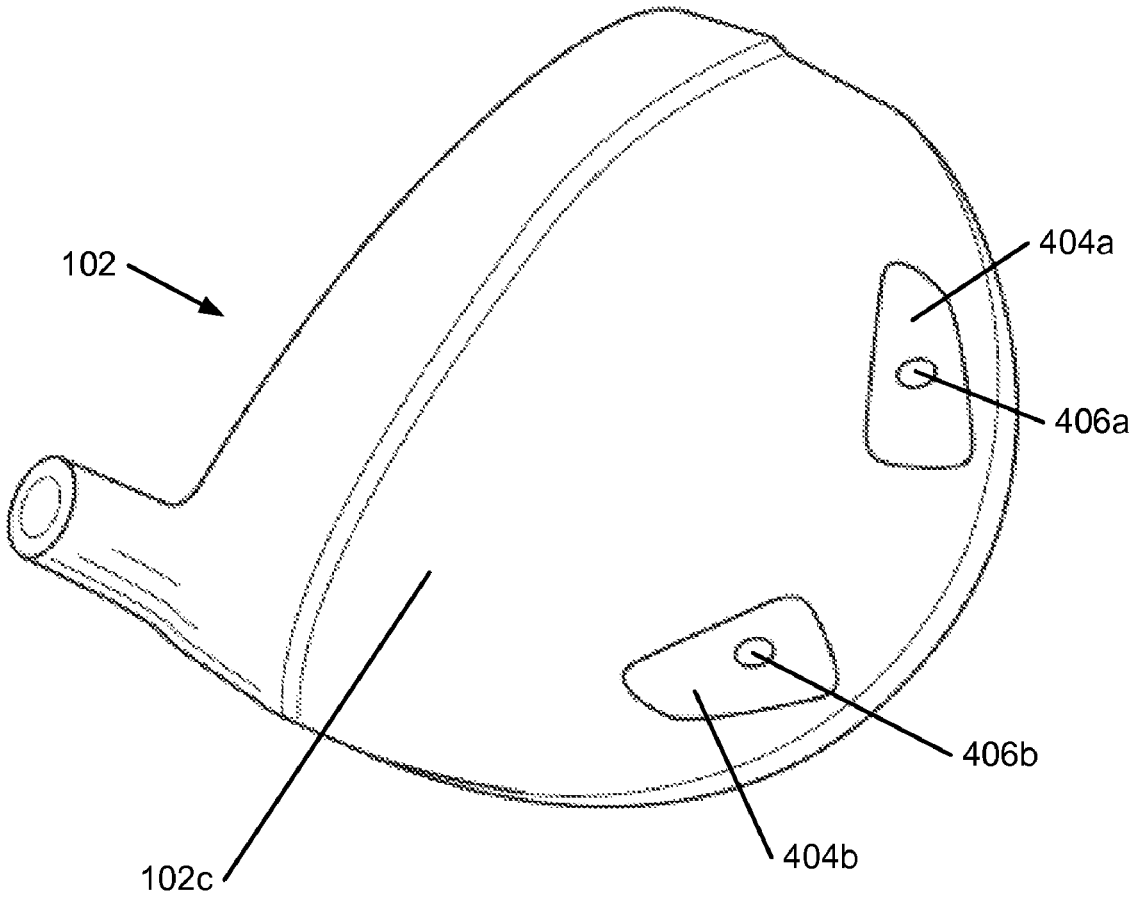

FIGS. 4A & 4B—Weight Inserts Only

FIGS. 4A and 4B illustrate an additional example feature and structure that may be included in golf club 100 and golf club head 102 structures in accordance with this invention. As shown in these figures, the top or crown portion 102*c* of this club head structure 102 includes at least one receptacle 410*a*, 410*b* (two in this example) defined therein on a side of the crown portion 102*c* away from the ball striking face 103*a* and at least one weight insert 404*a*, 404*b* (two in this example). The receptacles 410*a*, 410*b* may also be a slot or a groove. The receptacles 410*a*, 410*b* may be open or "bottomless" (e.g., so that it opens into an open or hollow space defined by the interior of the crown portion 102*c*) or closed (e.g., extending only partially through the crown portion 102*c*) without departing from this invention.

As shown, the club head 102 may be formed to include appropriate structures (such as threaded holes at the locations of mounting members 414*a*, 414*b*, etc.) that engage mechanical connectors 406*a*, 406*b* (such as screws) to hold the weight inserts 404*a*, 404*b* and golf club head 102 together.

As shown in FIG. 4A, the crown portion 102*c* of the golf club head 102 may also include at least one weight insert 404*a*, 404*b*, two in this example. The weight inserts 404*a*, 404*b* may be at least partially located within the at least one receptacle 410*a*, 410*b* (two in this example). The weight inserts 404*a*, 404*b* may be configured to be mounted within the receptacles 410*a*, 410*b*. The at least one receptacle may be located anywhere on the crown portion 102*c* to accommodate the desired center of gravity and associated alterable effects. In the specific embodiment shown in FIG. 4*a*, the receptacles 410*a*, 410*b* are on a side of the crown portion 102*c* away from the ball striking face 102*b* and proximal to the rear of the crown portion. There may be one or more weight inserts 404*a*, 404*b*, two in this example. As shown, the weight inserts 404*a*, 404*b* may include at least one receiving hole 416*a*, 416*b* (e.g., screw hole), two in this example, for receiving mechanical connectors 406*a*, 406 for attaching the weight inserts 404*a*, 404*b* to the golf club head 102. The mechanical connectors 406*a*, 406*b* (e.g., screws, rivets, turnbuckles, etc.) may extend through the receiving hole 416*a*, 416*b*, and through the openings in the mounting members 414*a*, 414*b*, respectively (e.g., threaded holes, nuts, etc.). There may be one or more receiving holes 416*a*, 416*b*. The number of receiving holes 416*a*, 416*b* will equal the number of mounting members 414*a*, 414*b* and the number of mechanical connectors 406*a*, 406*b*, which can be accommodated.

As illustrated in FIG. 4B, the weight inserts 404*a*, 404*b* are inserted into the receptacles 410*a*, 410*b* of the crown portion 102*c* and golf club head 102. As also illustrated in FIG. 4B, the mechanical connectors 406*a*, 406*b* are inserted through the receiving holes 416*a*, 416*b* and into the mounting members 414*a*, 414*b* to attach the weight inserts 404*a*, 404*b* to the golf club head 102. A wide variety of other ways of securing the weight inserts 404*a*, 404*b* to the golf club head 102 are possible without departing from this invention, including, for example, friction fits, mechanical connectors, retaining member/groove or opening structures, spring loaded mechanisms, hook and loop fasteners, etc. If desired, the exposed head of the mechanical connector 406*a*, 406*b* may fit into a countersink opening provided in the top surface of the weight insert 404*a*, 404*b* so that the mechanical connector head is flush to the weight insert 404*a*, 404*b* and the rest of the crown portion 102*c* of the golf club head 102. If desired, cover members may be provided (not shown) to cover any exposed or open holes to prevent dirt or debris from entering the opening 410*a*, 410*b* and/or the club head body interior during use.

As further illustrated in FIG. 4B, the weight inserts 404*a*, 404*b* are attached to the rear area of the crown portion 102*c* on a side of the crown portion 102*c* away from the ball striking face 102*b*. A wide variety of sizes, shapes, positioning, orientations, relative orientations, mass, and/or materials may be used for the weight inserts 404*a*, 404*b* without departing from this invention. Such constructions enable users (or club fitters) to provide additional weight in the toe and/or rear portion(s) of an overall club head structure 102, which can be useful to provide a fade biased club and/or a club that helps compensate for swing flaws that typically produce a drawing or hooking ball flight.

Also, changing the weight inserts 404*a*, 404*b* may allow users or club fitters to affect the flight of balls propelled using club heads 102 and golf clubs 100 in accordance with these examples of the invention. For example, it is typically easier for at least some golfers to get a golf ball airborne using a club head 102 having significant weight located lower and toward the rear of the club head 102. Such weight positioning also may be used to provide a higher, more lofted golf ball flight path, at least for some golfers. Under some play conditions and/or for some swing types, however, this higher flight bias and/or ball flight path may not be desirable. For example, to produce lower, more boring ball flights, e.g., for play in windy conditions, or for swing flaws that typically produce an excessively high, ballooning ball flight, the weight may be positioned more forward toward the ball striking face.

Alternate Configurations

Figure 5A:
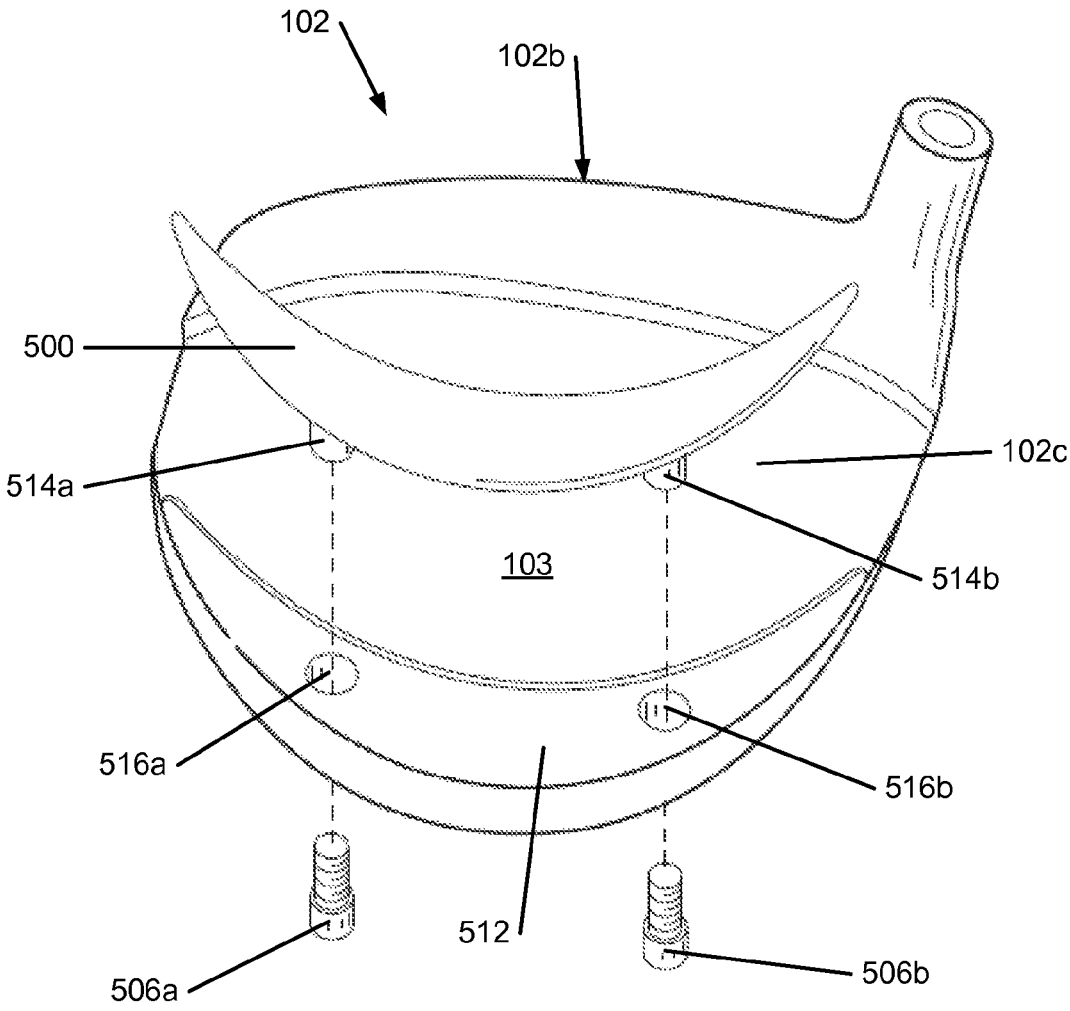
FIGS. 5A and 5B illustrate a golf club head structure including a removable weight portion attachable from the sole portion that may be used in accordance with at least some examples of this invention.
Figure 5B:
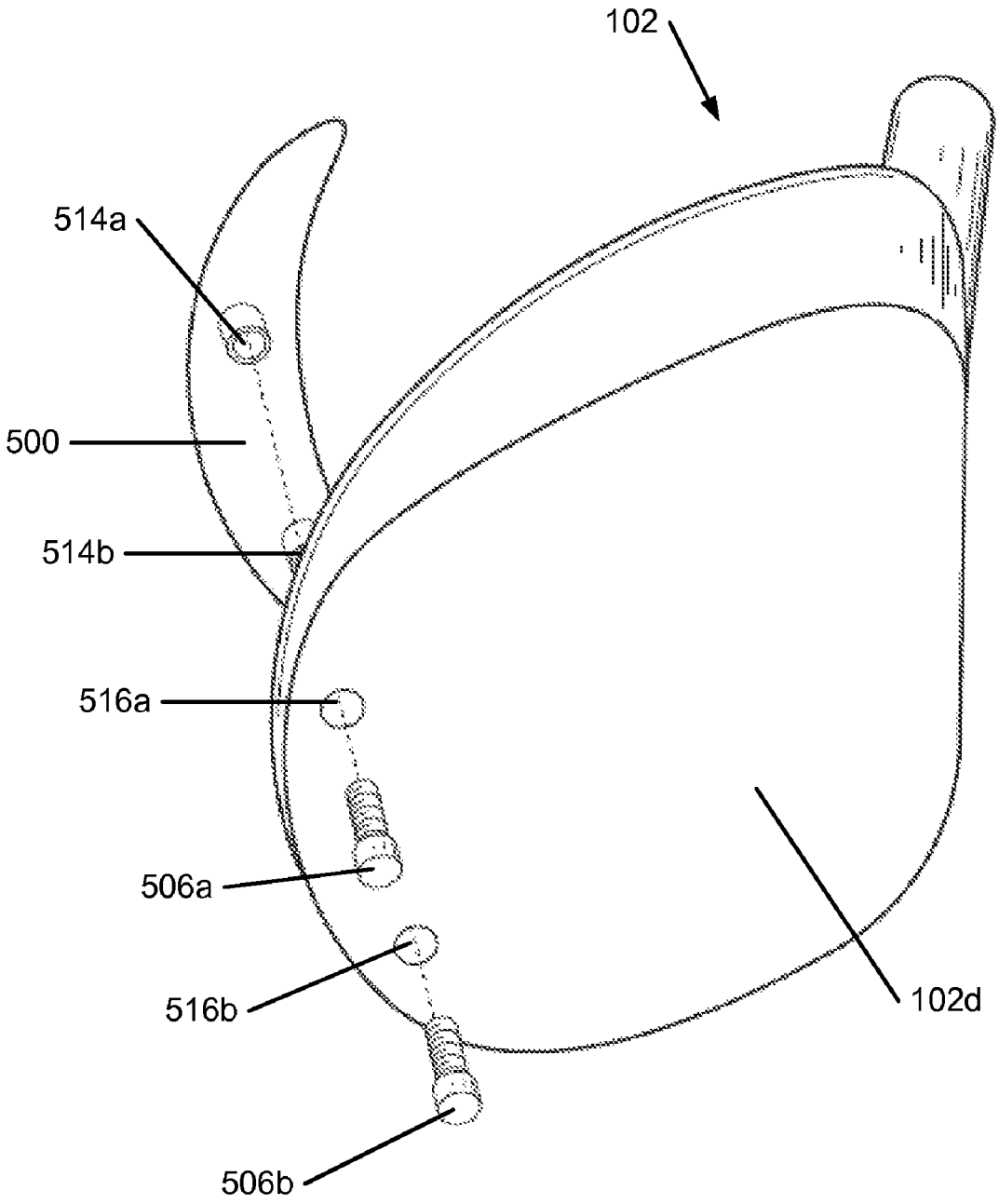

FIGS. 5A and 5B illustrate an additional example feature and structure that may be included in golf club 100 and golf club head 102 structures in accordance with this invention. While FIGS. 2A-4B illustrated the mechanical connectors (e.g., screws, pins, rivets) being inserted into the top of crown portion 102*c* of the golf club head 102, FIGS. 5A and 5B illustrate an example wherein the mechanical connectors 506*a*, 506*b* are inserted through the sole portion 102*d* of the golf club head 102. If desired, the weight 500 (or the weight inserts if they are being used without the use of the removable weight portion and weight member) may be formed to include appropriate structures (such as mounting members 514*a*, 514*b* with threaded holes) that engage mechanical connectors 506*a*, 506*b* (such as screws) to attach the removable weight portion 500 to the golf club head 102. The sole portion 102*d* may include at least one opening 516*a*, 516*b* (two in this example) for receiving a mechanical connector 506*a*, 506*b*

(two in this example). The mechanical connectors 506*a*, 506*b* (e.g., screws, rivets, pins, etc.) can extend through the openings 516*a*, 516*b* in the sole portion 102*d* and through the openings of the mounting members 514*a*, 514*b* (e.g., threaded holes, nuts, etc.). If desired, the exposed head of the mechanical connector 506*a*, 506*b* may fit into a countersink opening provided in the bottom surface of the sole portion 102*d* so that the mechanical connector head does not extend beyond the bottom surface of the sole portion 102*d* (e.g., so that it will not contact the ground when the golfer makes a stroke). If desired, cover members may be provided (not shown) to cover any exposed or open holes to prevent dirt or debris from entering the club head body interior during use. Those skilled in the art will recognize that the feature of this embodiment, mechanical connectors engaging through the sole portion of the club head may be used for those embodiments in FIGS. 2A-4B.

Figure 6:
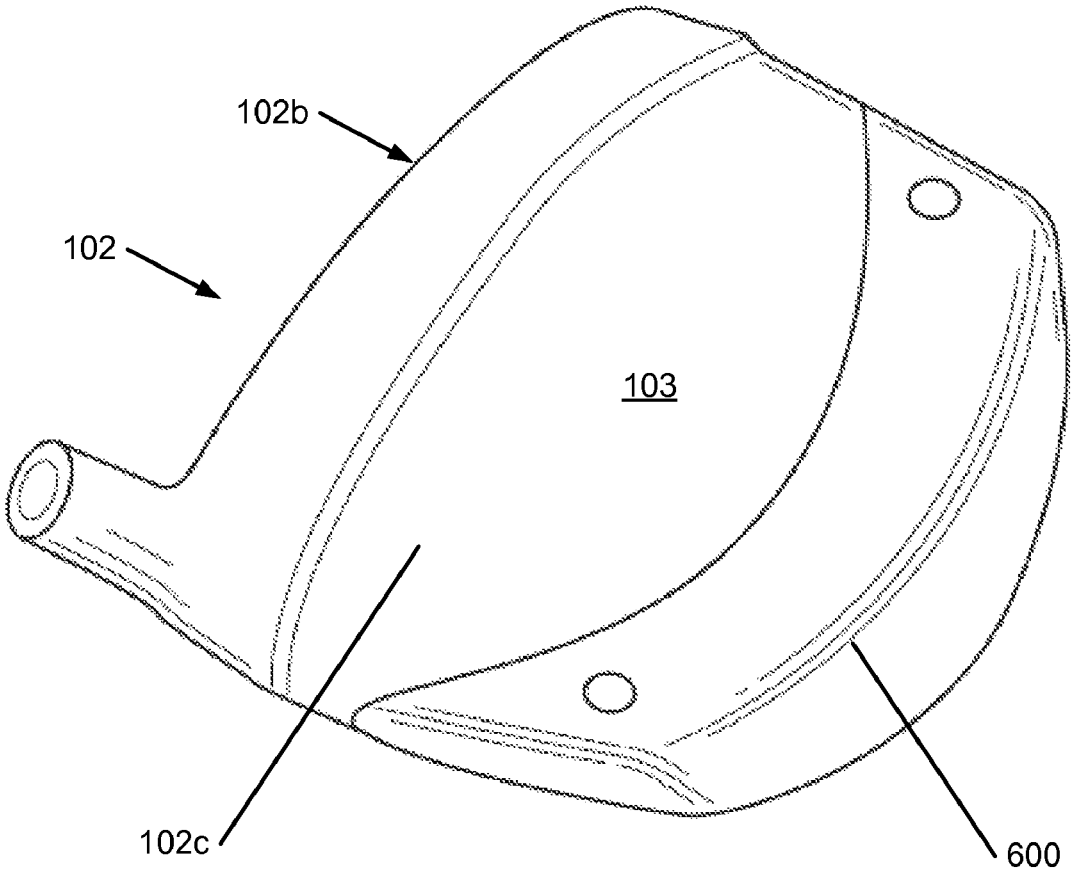
FIG. 6 illustrates a golf club head structure including a square removable weight portion that may be used in accordance with at least some examples of this invention.

FIG. 6 illustrates an additional example feature and structure that may be included in golf club 100 and golf club head 102 structures in accordance with this invention. The removable weight portion may also be replaced by a different removable weight portion 600. This removable weight portion could be used to change the overall shape or weighting of the club (e.g., to change from a rounded traditional club head shape to a more modern square type shape as shown in FIG. 6).

General Construction

The crown portion 102*c*, sole portion 102*d*, and frame member 212 may be held together in other ways as well, without departing from this invention. For example, mechanical connectors other than screws or bolts may be used, such as retaining members, spring loaded detents or other mechanisms, etc. As still additional examples, if desired, magnets, adhesives or cements, as well as soldering, brazing, welding, and/or other fusing techniques may be used, at least in part, to hold one or more of the various parts of the club head structure 102 together and/or to one another. Also, any combination of techniques, such as the techniques described above, may be used to hold one or more of the various parts of the club head structure 102 together.

The crown member 102*c* and/or the sole member 102*d* may be made from any desired material, including the same or different materials (and the same or different material(s) from the frame member 212) without departing from this invention. In at least some example structures, the crown member 102*c* and/or the sole member 102*c* will be made of a lightweight material, such as: a polymeric material; a composite material (such as carbon fiber composites, fiberglass materials, basalt fiber composites, and the like); a lightweight metal material (e.g., titanium alloys, aluminum alloys, magnesium alloys, etc.). Additionally, the crown member 102*c* and/or the sole member 102*d* may be made from conventional materials that are known and used in the golf club art. These parts also may be made from and formed into desired shapes using fabrication techniques that also are well known and used in the art (e.g., by molding techniques, such as blow molding or injection molding of polymeric materials, molding or shaping of composite materials, etc.; by conventional metal fabrication and shaping techniques, such as molding, shaping, casting, forging, machining, etc.; and the like).

If desired, the crown member 102*c* and/or the sole member 102*d* may serve as mounting elements or bases for still further elements, such as finishing materials (e.g., paint, enamel, or other finishing materials) to provide a desired aesthetic appearance; a sole plate (e.g., made of metal or other durable materials) to protect at least portions of the club head structure 102 during use (e.g., when the club head contacts the ground during a swing, etc.); etc. Use of such additional elements may be accomplished in conventional ways that are known and used in the art. As a more specific example, a sole plate (optionally made from a metal material) may be fixed to the sole portion 102*d*, e.g., using mechanical connectors, cements, adhesives, etc.

While various weight attaching structures and techniques are described above (e.g., removable weight portion and weight inserts) in conjunction with various specific structures shown in FIGS. 1A through 6, features and aspects of this invention may be applied to a wide variety of club head structures or constructions without departing from the invention. For example, a wide variety of constructions, numbers of parts, combinations of materials, and the like may be used, including constructions, parts, and combinations of materials that are known and used in the art. More specific examples of additional potential club head constructions that may include weight attaching structures and/or weighting techniques of the types described above include, but are not limited to: one piece club constructions, e.g., of metallic or metal alloy materials, polymer-containing materials, or composite-containing materials, either as a solid material or a having a hollow interior chamber within the club head; constructions having a face member (e.g., a face frame member with a face plate attached thereto or integrally formed therewith) with an aft body attached thereto (the aft body may be constructed from one or more of metallic or metal alloy materials, polymer-containing materials, or composite-containing materials, either as a solid material or a having a hollowed out interior chamber); multi-piece constructions, e.g., constructions having a face member (e.g., a face frame member with a face plate attached thereto or integrally formed therewith) with a multi-piece body attached thereto (the body may be constructed from one or more of metallic or metal alloy materials, polymer-containing materials, or composite-containing materials, e.g., including one or more of a crown member, a sole member, one or more body ribbons, etc); etc. A wide variety of other constructions also are possible.

Weight adjustable golf club heads of the types described above may be used by golfers, on the golf course, for their regular play (golfers can maintain the ability to modify the weight settings and/or customize the club head to their swing characteristics). As another example, however, golf club heads in accordance with at least some examples of this invention (e.g., of the types described above) also may be useful for club fitting purposes. For example, removable weights of the types described above, club fitters and/or users can quickly adjust the playing characteristics of a club head by changing the weights in the removable weight portion provided with the club head. In this manner, a golfer being fit for new clubs and/or club components can quickly try different weighting characteristics for the club head using a single club head (as opposed to the club fitter having to carry a large inventory of club heads each with slightly different weighting characteristics). Then, when a weight arrangement is found that best suits a golfer's swing characteristics and/or provides a desired ball flight path, based on the adjustable club head's settings (e.g., the mass of the weights provided in the various weight receptacles, etc.), the club fitter can order or build a club head for the golfer having permanent weighting characteristics based on and derived from the removable and interchangeable weights used during the fitting session(s).

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 6 may be used individually and/or in any combination or subcombination without departing from this invention.

We claim:

1. A wood-type golf club head, comprising:

a ball striking face; and a club head body engaged or integrally formed with the ball striking face, wherein the club head body includes a crown portion, the crown portion including at least one receptacle located on a proximate rear of the crown portion away from the ball striking face and at least one weight insert at least partially located within the at least one receptacle, wherein the at least one weight insert is configured to be mounted within the at least one receptacle using at least one mechanical connector inserted into the bottom of the golf club body.

2. A wood-type golf club head according to claim 1, wherein the club head body is metal.

3. A wood-type golf club head according to claim 1, wherein the at least one mechanical connector is a screw.

4. A wood-type golf club head according to claim 1, wherein the crown portion is made from a material selected from the group consisting of: a polymeric material, a composite material, a fiber-reinforced composite material, a light-weight metal material.

5. A wood-type golf club head according to claim 1, wherein the at least one weight insert is made from a material selected from the group consisting of: a polymeric material, a composite material, a fiber-reinforced composite material, a light-weight metal material.

6. A wood-type golf club head according to claim 1, wherein the club head body constitutes a driver body.

7. A wood-type golf club, comprising:

a club head including a ball striking face and a club head body engaged or integrally formed with the ball striking face, wherein the club head body includes a crown portion, the crown portion including at least one receptacle located on a proximate rear of the crown portion away from the ball striking face and at least one weight insert at least partially located within the at least one receptacle, wherein the at least one weight insert is configured to be mounted within the receptacle using at least one mechanical connector inserted into the bottom of the golf club body; and a shaft member engaged with the club head.

8. A wood-type golf club according to claim 7, wherein the club head body is metal.

9. A wood-type golf club according to claim 7, wherein the at least one mechanical connector is a screw.

10. A wood-type golf club according to claim 7, wherein the crown portion is made from a material selected from the group consisting of: a polymeric material, a composite material, a fiber-reinforced composite material, a light-weight metal material.

11. A wood-type golf club according to claim 7, wherein the at least one weight insert is made from a material selected from the group consisting of: a polymeric material, a composite material, a fiber-reinforced composite material, a light-weight metal material.

12. A wood-type golf club according to claim 7, wherein a grip member is engaged with the shaft member.

13. A wood-type golf club according to claim 7, wherein the club is a driver body.

14. A method for producing a wood-type golf club, comprising:

providing a club head including a ball striking face and a club head body engaged or integrally formed with the ball striking face, wherein the club head body includes crown portion, the crown portion including at least one receptacle located on a proximate rear of the crown portion away from the ball striking face and at least one weight insert at least partially located within the at least one receptacle; wherein the at least one weight insert is configured to be mounted within the receptacle using at least one mechanical connector inserted into the bottom of the golf club body;

mounting the at least one weight insert within the receptacle; and engaging a shaft member with the club head body.

* * * * *